US010508634B2

(12) United States Patent
Rau

(10) Patent No.: US 10,508,634 B2
(45) Date of Patent: Dec. 17, 2019

(54) INJECTION NOZZLE FOR FUELS

(71) Applicant: Robert Bosch GmbH, Stuttgart (DE)

(72) Inventor: Andreas Rau, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 242 days.

(21) Appl. No.: 15/537,728

(22) PCT Filed: Oct. 27, 2015

(86) PCT No.: PCT/EP2015/074892
§ 371 (c)(1),
(2) Date: Jun. 19, 2017

(87) PCT Pub. No.: WO2016/096217
PCT Pub. Date: Jun. 23, 2016

(65) Prior Publication Data

US 2018/0274508 A1 Sep. 27, 2018

(30) Foreign Application Priority Data

Dec. 18, 2014 (DE) ..... 10 2014 226 407

(51) Int. Cl.
*F02M 61/16* (2006.01)
*F02M 47/02* (2006.01)
(Continued)

(52) U.S. Cl.
CPC ..... *F02M 61/166* (2013.01); *F02M 47/02* (2013.01); *F02M 47/027* (2013.01);
(Continued)

(58) Field of Classification Search
CPC ..... F02M 61/166; F02M 61/04; F02M 61/10; F02M 61/12; F02M 61/20; F02M 61/042;
(Continued)

(56) References Cited

U.S. PATENT DOCUMENTS 6,705,551 B1 3/2004 Kienzler et al.
2005/0224604 A1* 10/2005 Uhlmann ..... F02M 47/027 239/533.2
(Continued)

FOREIGN PATENT DOCUMENTS

CN 1727666 A 2/2006
CN 102597485 A 7/2012
(Continued)

OTHER PUBLICATIONS

International Search Report for Application No. PCT/EP2015/074892 dated Jan. 26, 2016 (English Translation, 3 pages).
(Continued)

*Primary Examiner* — Steven J Ganey
*Assistant Examiner* — Tuongminh N Pham
(74) *Attorney, Agent, or Firm* — Michael Best & Friedrich LLP

(57) ABSTRACT

The invention relates to an injection nozzle (1) for fuels, comprising a nozzle body (2), in which a pressure chamber (4) that can be filled with fuel under high pressure is formed, in which pressure chamber a piston-shaped nozzle needle (3) is arranged in such a way that the nozzle needle can be moved longitudinally. A sealing surface (6) is formed at one end of the nozzle needle (3) and an end face (9) is formed at the opposite end, wherein the sealing surface (6) interacts with a nozzle seat (5) in order to open and close at least one injection opening (8). A control chamber (10) that can be filled with fuel under changing pressure is bounded by the end face (9) of the nozzle needle (3) such that a force can be applied to the end face (9) in the direction of the nozzle seat (5) by means of the hydraulic pressure. The nozzle needle (3) has an elastic longitudinal segment (25), which has a longitudinal stiffness of less than 40,000 N/mm.

18 Claims, 4 Drawing Sheets

(51) Int. Cl.
*F02M 61/04* (2006.01)
*F02M 61/12* (2006.01)
*F02M 61/20* (2006.01)
*F02M 61/10* (2006.01)

(52) U.S. Cl.
CPC ..... *F02M 61/042* (2013.01); *F02M 61/10* (2013.01); *F02M 61/12* (2013.01); *F02M 61/205* (2013.01); *F02M 2200/26* (2013.01); *F02M 2200/9053* (2013.01); *F02M 2547/001* (2013.01)

(58) Field of Classification Search
CPC .. F02M 47/02; F02M 47/027; F02M 2200/26; F02M 2200/9053; F02M 2547/001
USPC ..... 239/533.13
See application file for complete search history.

(56) References Cited

U.S. PATENT DOCUMENTS

2011/0133002 A1* 6/2011 Kuegler ..... F02M 61/10 239/584
2012/0205470 A1* 8/2012 Spindler ..... F02M 47/027 239/585.5
2012/0318893 A1* 12/2012 Crossley ..... F02M 51/0675 239/584
2015/0076379 A1* 3/2015 Schuessler ..... B60T 17/04 251/120
2015/0337968 A1* 11/2015 Strand ..... F16K 5/06 251/315.01

FOREIGN PATENT DOCUMENTS

| | | |
|---|---|---|
| DE | 19936668 | 2/2001 |
| DE | 19940294 | 3/2001 |
| DE | 10237003 | 3/2004 |
| DE | 102006036446 | 2/2008 |
| DE | 102008001601 | 11/2009 |
| DE | 102008002526 | 12/2009 |
| EP | 1422418 | 5/2004 |
| EP | 2664779 | 11/2013 |

OTHER PUBLICATIONS

Horst Stocker, "Taschenbuch Physik" In: "Taschenbuch Physik," Jun. 19, 2003, XP055241119, pp. 224-225.

* cited by examiner

INJECTION NOZZLE FOR FUELS

BACKGROUND OF THE INVENTION

The invention relates to an injection nozzle for fuels, such as finds application, for example, for injecting fuel into combustion chambers of internal-combustion engines.

Injection nozzles for fuels, in particular for injecting fuel under high pressure into combustion chambers of internal-combustion engines, have long been known from the state of the art. Accordingly, a fuel injector with an injection nozzle is known from DE 199 36 668 A1, wherein the injection nozzle has a nozzle body with a pressure chamber formed therein. Arranged in longitudinally displaceable manner in the pressure chamber is a piston-shaped nozzle needle which has a sealing surface at one end, with which it interacts with a nozzle seat formed in the nozzle body for the purpose of opening and closing at least one injection port. For the purpose of controlling the longitudinal motion of the nozzle needle, at the end situated opposite the nozzle seat a control chamber has been formed which can be filled with fuel under high pressure and in which, via a control valve, a variable fuel pressure can be set by which a closing force can be exerted on the nozzle needle in the direction of the nozzle seat. The pressure chamber is connected to a fuel reservoir in which fuel is held under high pressure, in order to supply the pressure chamber with fuel under constant high pressure at all times.

The sealing of the injection ports by the resting of the nozzle needle on the nozzle seat represents the closed state of the injection nozzle. If fuel is to be injected into a combustion chamber, the nozzle needle is moved away from the nozzle seat in the longitudinal direction, by the hydraulic pressure in the control chamber being lowered. The hydraulic forces in the pressure chamber thereupon move the nozzle needle away from the nozzle seat, and the injection ports are released from the nozzle needle, so that fuel is ejected from the pressure chamber through the injection ports. In this process it is important for a clean injection that the nozzle needle moves away from the nozzle seat very rapidly. If it does so only slowly, a throttle gap forms between the sealing surface of the nozzle needle and the nozzle seat, through which fuel flows out of the pressure chamber to the injection ports only with reduced pressure, so that this fuel is only inadequately atomized when it emerges from the injection ports. Accordingly, this so-called seat-throttle region has to be kept as short as possible by a rapid movement of the nozzle needle, in order to increase the effective injection pressure at the injection ports rapidly to the level within the pressure chamber in order to obtain a good atomization of the fuel. Insufficiently atomized fuel otherwise results in insufficient combustion within the combustion chamber, and hence in increased hydrocarbon emissions of the internal-combustion engine.

For the purpose of increasing the needle-opening speed, the pressure in the control chamber can be lowered as rapidly as possible. This can be obtained by the outflow throttle, via which the fuel can flow away out of the control chamber, being configured with a large cross-section of flow in relation to the inflow throttle via which the control chamber is filled with fuel under high pressure. If the control chamber is additionally also filled via the outflow throttle, by the outflow throttle being connected to the high pressure with the control valve closed, any enlargement of the throttles results in a faster build-up of pressure or reduction of pressure. However, a rapid drop in pressure or build-up of pressure impairs the capability of the injection valve to handle extremely small amounts, since as a result the injected quantity of fuel reacts very sensitively to the actuation-time of the control valve. This entails a large stroke-to-stroke scatter—that is to say, a greater stochastic scattering of the injected quantity around the desired value from injection to injection.

Furthermore, a certain limit is set to the speed of the drop in pressure within the control chamber by virtue of the fact that in many applications the nozzle needle is operated in the so-called ballistic mode in which the nozzle needle does not reach a mechanical stroke stop but is retarded prior to reaching a stroke stop by renewed rise in pressure within the control chamber and is accelerated back in the direction of the nozzle seat. However, if the pressure in the control chamber drops too rapidly, this ballistic mode can no longer be realized, since the nozzle needle reaches the mechanical stroke stop prematurely by reason of its high opening speed.

SUMMARY OF THE INVENTION

The injection nozzle according to the invention has the advantage, in contrast, that the injection of fuel is effected by a rapid opening and rapid closing of the nozzle needle at the start and end, respectively, of the injection of fuel with high pressure at all times and hence with good atomization of the fuel, and consequently lowers the noxious emissions of the internal-combustion engine. For this purpose, the injection nozzle has a nozzle body in which a pressure chamber has been formed which can be filled with fuel under high pressure and in which a piston-shaped nozzle needle is arranged in longitudinally mobile manner. The nozzle needle has a sealing surface at one end and an end surface at its opposite end, said sealing surface of said nozzle needle interacting with a nozzle seat for the purpose of opening and closing at least one injection port. Moreover, a control chamber is present which can be filled with fuel under high pressure, in which a variable pressure can be set, and which the nozzle needle delimits with the end surface, so that a force can be exerted in the direction toward the nozzle seat by the hydraulic pressure on the end surface of the nozzle needle. The nozzle needle has an elastic longitudinal portion which has a longitudinal stiffness of less than 40,000 N/mm.

By virtue of the design of the elastic longitudinal portion, the effective opening speed of the nozzle needle can be crucially improved. By reason of the axial compression of the nozzle needle caused by the high pressure in the control chamber, the elastic longitudinal portion results in a so-called snap-action effect of the nozzle needle, which increases the actual opening speed and in this way has the result that at the start of the opening motion the sealing surface of the nozzle needle moves away from the nozzle seat more quickly in comparison with a known nozzle needle. The same effect also arises in the course of the closing motion nozzle needle, so that the speed of the sealing surface also increases in the course of the approach of the nozzle needle to the nozzle seat, and hence the seat-throttle region is passed through more quickly. For more detailed explanatory remarks on this effect, reference is made to the description.

In an advantageous configuration, the longitudinal stiffness of the elastic portion is less than 20,000 N/mm, particularly preferably 12,000 N/mm to 16,000 N/mm. Within these ranges of longitudinal rigidity the maximum effect is obtained, without the stability of the nozzle needle and the manufacturability of the nozzle needle becoming technically problematic.

In a further advantageous configuration, the longitudinally elastic portion takes the form of a circular cylinder, the material of the nozzle needle preferentially being steel. In this case the longitudinally elastic, circular cylindrical portion preferably has a diameter from 1.3 mm to 2.0 mm, preferably between 1.4 mm and 1.6 mm. In this case the modulus of elasticity of the steel preferably has a value from 200,000 $N/mm^2$ to 230,000 $N/mm^2$, preferentially 210,000 $N/mm^2$.

In a further advantageous configuration, the cylindrical elastic longitudinal portion has a length from 20 mm to 30 mm, preferentially 25 mm to 27 mm. Such a length can be accommodated without difficulty in the normal injection nozzles such as are preferentially used for fuel injectors, without the construction space of the nozzle having to be increased in comparison with the models known hitherto.

In a further advantageous configuration, the sealing surface of the nozzle needle has an annular sealing line with which in the closed state of the injection nozzle it rests on the nozzle seat and seals the pressure chamber against the injection ports. This sealing line has the same diameter as the diameter of the longitudinally elastic portion, so that in this region of the nozzle needle no resultant hydraulic forces are exerted on the nozzle needle in the longitudinal direction by the fuel pressure within the pressure chamber.

In a further advantageous configuration, guide portions are located on the nozzle needle respectively upstream and downstream of the elastic longitudinal portion, with which the nozzle needle is guided in the radial direction in the pressure chamber. These guide portions are constituted, for example, by diameter extensions, in which case passages, which ensure a throttle-free flow of fuel to the injection ports within the pressure chamber, have been formed on the guide portions.

In a further advantageous configuration, the nozzle needle with its end facing away from the sealing surface is accommodated in a sleeve which radially delimits the control chamber. In this case a closing spring under initial compressive tension, which exerts a closing force on the nozzle needle in the direction toward the nozzle seat, is advantageously arranged between the sleeve and the nozzle needle. The closing spring ensures that the nozzle needle remains in abutment on the nozzle seat even when the internal-combustion engine has been switched off, and in this way a dripping of fuel into the combustion chamber does not happen, even in the absence of pressure in the control chamber.

Advantageously, a fuel injector for injecting fuel into a combustion chamber of an internal-combustion engine is equipped with an injection nozzle according to the invention.

BRIEF DESCRIPTION OF THE DRAWINGS

An injection nozzle according to the invention is represented in the drawing. Shown are.

DETAILED DESCRIPTION

Figure 1:
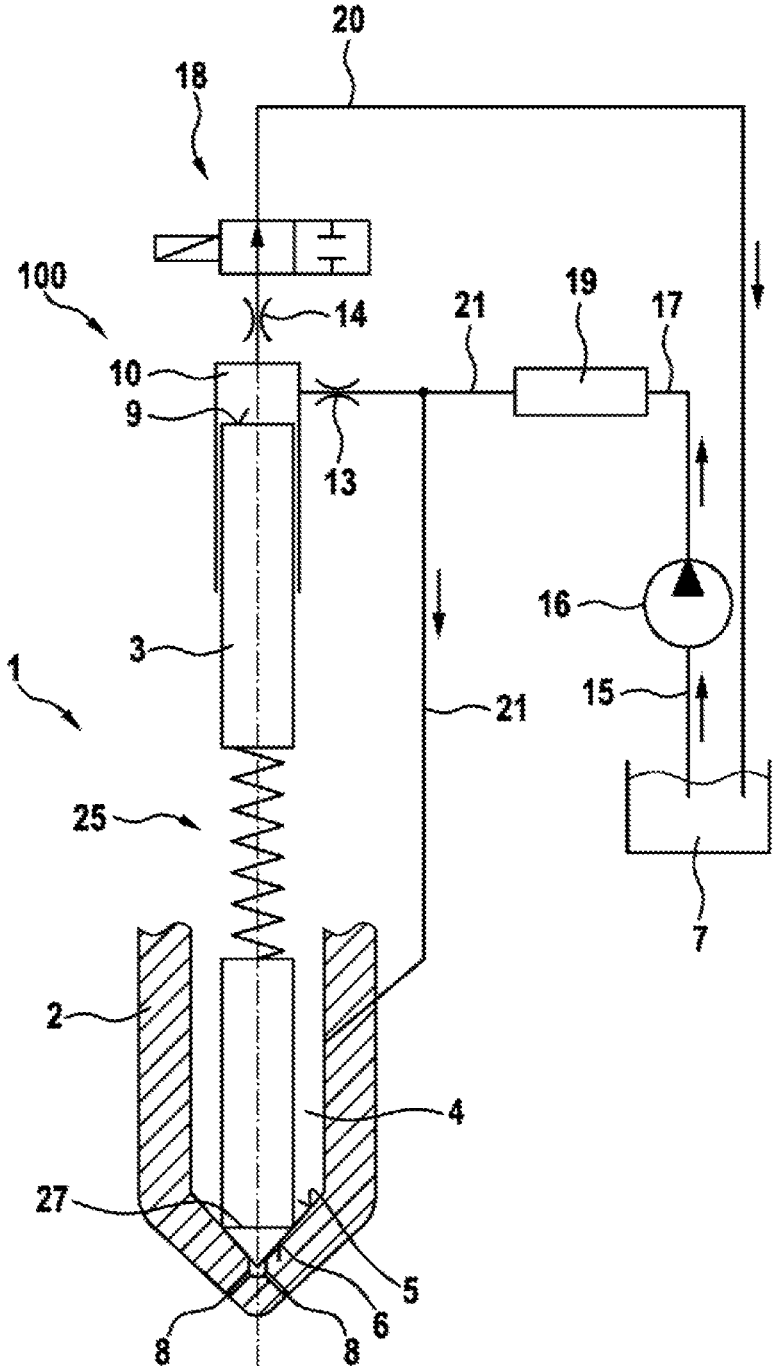
FIG. 1: in schematic representation, an injection nozzle according to the invention together with the schematically represented injection system.

In FIG. 1 a fuel injector according to the invention is represented schematically together with the associated injection system. The fuel injector 100 has an injection nozzle 1 which includes a nozzle body 2 in which a pressure chamber 4 has been formed. The pressure chamber 4 can be filled with fuel under high pressure. For this purpose, fuel from a fuel tank 7 is supplied via a fuel line 15 to a high-pressure pump 16 which compresses the fuel and supplies the compressed fuel via a pressure line 17 to a high-pressure collecting chamber 19 in which the compressed fuel is held. From the high-pressure collecting chamber 19 a high-pressure line 21 branches off, corresponding to the number of existing fuel injectors 100, via which the pressure chamber 4 is filled with fuel under high pressure.

A piston-shaped nozzle needle 3, which is represented here in highly schematic manner, is arranged in longitudinally displaceable manner in the pressure chamber 4. The nozzle needle 3 has a longitudinally elastic portion 25 which is symbolized here by a spring but consists, for example, of a tapered cylindrical portion of the nozzle needle 3. The nozzle needle 3 has a sealing surface 6 with which the nozzle needle 3 interacts with the nozzle seat 5 which has been formed at the combustion-chamber end of the nozzle body 2, so that when the sealing surface 6 is in abutment on the nozzle seat 5 one or more injection ports 8 which have been formed in the nozzle body 2 are sealed against the pressure chamber 4. If the nozzle needle 3 lifts off from the nozzle seat 5 in the longitudinal direction, fuel from the pressure chamber 4 flows through between the sealing surface 6 and the nozzle seat 5 to the injection ports 8 and is ejected through them.

The end of the nozzle needle 3 facing away from the sealing surface 6 has an end surface 9 which delimits a control chamber 10. The control chamber 10 can be filled with fuel under high pressure via an inflow throttle 13 which branches off from the high-pressure line 21. Furthermore, the control chamber 10 has been connected to an outflow throttle 14 which can be connected to a low-pressure line 20 via a control valve 18, said low-pressure line 20 leading back into the fuel tank 7. If the control valve 18 is in its opening position, as represented in FIG. 1, fuel flows out of the control chamber 10 into the fuel tank 7 via the low-pressure line 20, in the course of which the inflow throttle 13 and the outflow throttle 14 have been matched to one another in such a way that, when the control valve 18 is open, more fuel flows off via the outflow throttle 14 than continues to flow into the control chamber 10 via the inflow throttle 13 in the same period of time. As a result, a drop in pressure occurs in the control chamber 10, and correspondingly a decrease of the hydraulic pressure on the end surface 9, so that the nozzle needle 3 is moved away from the nozzle seat 5 by the fuel pressure in the pressure chamber 4 and releases the injection ports 8. If the injection is to be terminated, the control valve 18 is closed again, as a result of which the high fuel pressure, which initially prevailed in the control chamber 10, builds up again and pushes the nozzle needle 3 back into its closed position in abutment against the nozzle seat 5, and in this way closes the injection ports 8.

Figure 2:
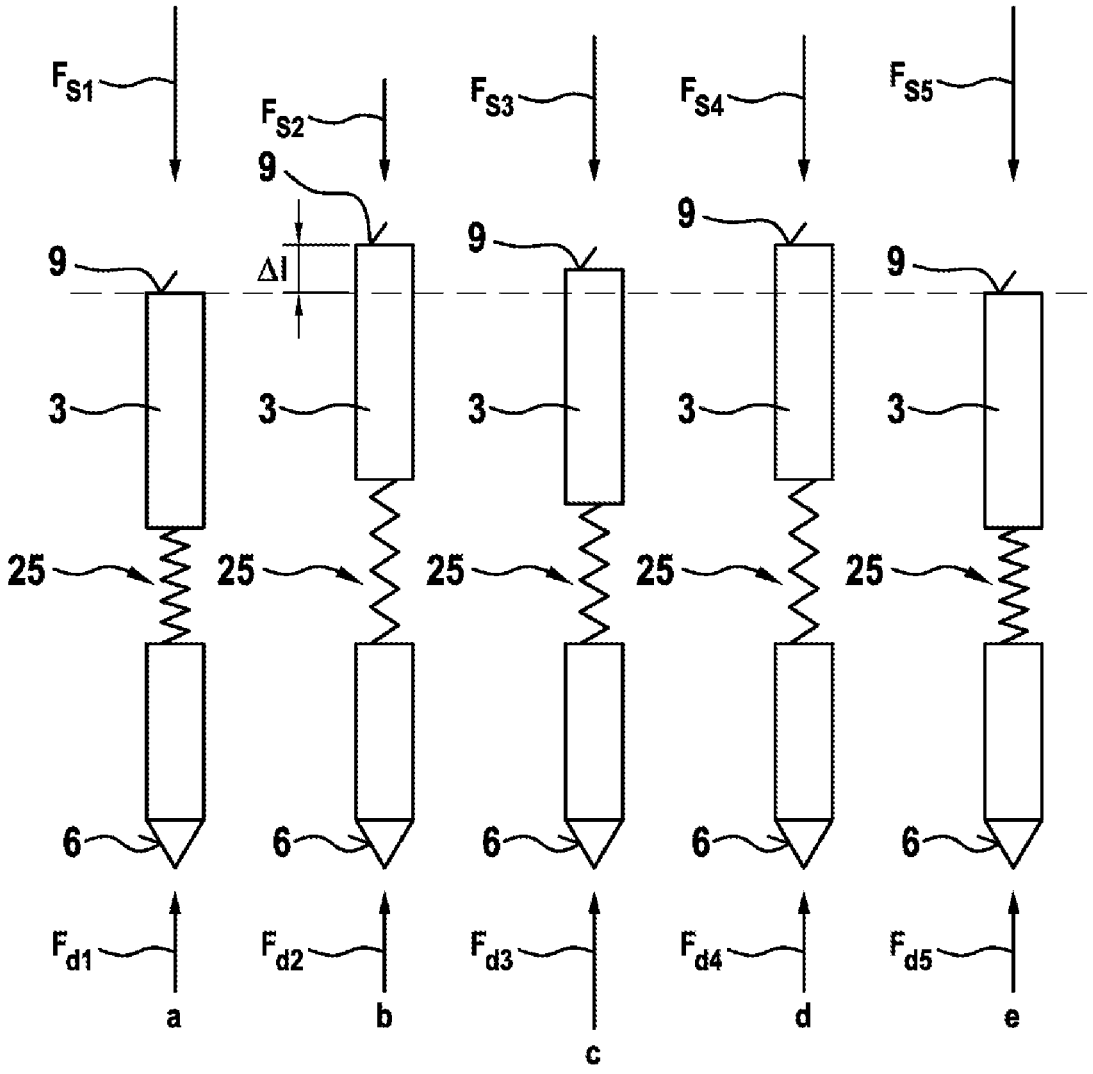
FIGS. 2*a* through 2*e*: a schematic representation of the change in length of the nozzle needle during an injection process.

The function of the elastic portion 25 is as follows and will also be explained in the following with reference to FIG. 2, which shows the state of the nozzle needle 3 schematically at various times of the injection cycle. In FIG. 2*a* the state of the nozzle needle 3 at the start of the injection is represented, in the course of which the nozzle needle 3 is in its closed position in abutment against the nozzle seat 5. The nozzle needle 3 in this case does not rest on the nozzle seat 5 with its entire sealing surface 6, but for the purpose of improving the imperviousness an annular sealing line 27 has been formed on the sealing surface 6, which brings about a substantially linear abutment of the sealing surface 6 on the nozzle seat 5. Since the surface below the sealing line 27 is not acted upon by the fuel pressure of the pressure chamber 4, there is no force, or only a negligible force, on the sealing surface 6 below the sealing line 27.

The high fuel pressure in the control chamber 10, which in modern injection systems may amount to more than 2000 bar, brings about a hydraulic force $F_{S1}$ on the end surface 9 of the nozzle needle, which is symbolized in FIG. 2*a* by an arrow and which compresses the nozzle needle 3. By virtue of the design of the elastic portion 25 of the nozzle needle 3, the axial compression occurs mainly in this region. Since practically no fuel pressure is applied below the sealing line 27—at most, the pressure that prevails in the combustion chamber and results in a force $F_{d1}$—an elastic axial compression of the nozzle needle 3 by a certain amount arises. If the pressure in the control chamber 10 is now reduced, the elastic portion 25 relaxes and results in a lengthening of the nozzle needle 3 by an amount Δl, as represented in FIG. 2*b*. The force $F_{S2}$ in the control chamber decreases, whereas the counterforce $F_{d2}$ remains approximately the same, since the nozzle needle 3 is still in its closed position—that is to say, has not yet lifted away from the nozzle seat 5.

If the nozzle needle 3 now lifts away from the nozzle seat 5, the sealing surface 6 of the nozzle needle 3 is infiltrated by the fuel pressure of the pressure chamber 3, so that an increased hydraulic force $F_{d3}$ is now also acting on the sealing surface 6, as represented in FIG. 2*c*. At the same time, force $F_{S3}$ also increases by virtue of the pressure in the control chamber, since the fuel is compressed by the nozzle needle 3 within the control chamber 10, as a result of which the nozzle needle is again axially compressed, this time by a hydraulic force at both ends, and shortens again. The elastic shortening of the nozzle needle 3 is not quite as great as in the closed position at the start of the opening-stroke motion, since the hydraulic force $F_{S3}$ in the control chamber and also the hydraulic force within the pressure chamber 4 have been somewhat lowered in comparison with the closed state. This is due, above all, to the fact that the pressure in the pressure chamber 4 is lowered by the opening of the nozzle needle 3 and hence the releasing of the injection ports 8, and at the same time the static pressure on the sealing surface 6 has been lessened by the flow of the fuel between the sealing surface 6 and the nozzle seat 5, which also lowers the hydraulic force on the sealing surface 6.

In the course of the closing motion of the nozzle needle 3 toward the nozzle seat 5, the sealing surface 6 comes into the vicinity of the nozzle seat 5, throttling the flow of fuel and hence the fuel pressure in the region of the sealing surface 6, so that the hydraulic force $F_{d4}$ distinctly decreases, as represented in FIG. 2*d*. By virtue of the discontinuation of the hydraulic force on the underside of the nozzle needle 3—that is to say, on the sealing surface 6—the nozzle needle 3 relaxes and lengthens again, as represented in FIG. 2*d*. As soon as the nozzle needle 3 reaches its initial position again—that is to say, the abutment on the nozzle seat 5—the initial pressure in the control chamber 10 builds up again, and hence the hydraulic force $F_{S5}$, as represented in FIG. 2*e*, again becomes maximal and shortens the nozzle needle 3 to its initial length, said shortening occurring mainly in the elastic portion 25.

The represented cyclic axial compression and relaxation of the nozzle needle 3 in the longitudinal direction by virtue of the elastic portion 25 brings about an additional acceleration of the sealing surface 6 in the course of lifting away from the nozzle seat 5. In this regard, in FIG. 3 the lengthening of the nozzle needle Δl and the stroke of the nozzle needle h in the temporal progression are represented. At time $t_0$ the control valve 18 is opened, so that the pressure in the control chamber 10 breaks down and the hydraulic force on the end surface 9 of the nozzle needle 3 decreases. As a result, the nozzle needle 3 lengthens by the length $\Delta l_2$ which is attained at time $t_1$. As soon as the nozzle needle 3 has completely relaxed—that is to say, has attained its maximal lengthening—the actual opening motion of the nozzle needle begins—that is to say, the sealing surface 6 moves away from the nozzle seat 5 and releases the injection ports 8. By virtue of the hydraulic conditions presented above, the nozzle needle 3 is now axially compressed again to a lengthening $\Delta l_1$, this being attained at time $t_2$. In this state, and up until time $t_3$, the nozzle needle 3 is in its ballistic-motion phase—that is to say, it has, on the one hand, left the seat-throttle region and, on the other hand, not reached a mechanical stop: hydraulic forces within the pressure chamber 4 and within the control chamber 10 are acting respectively on the sealing surface 6 and on the end surface 9. Shortly before the nozzle needle 3 has attained its maximal stroke $h_{max}$, the control valve 18 closes, so that the pressure in the control chamber 10 rises again. As a result, the motion of the nozzle needle 3 in the opening direction is retarded, and its direction of motion reverses.

Figure 3:
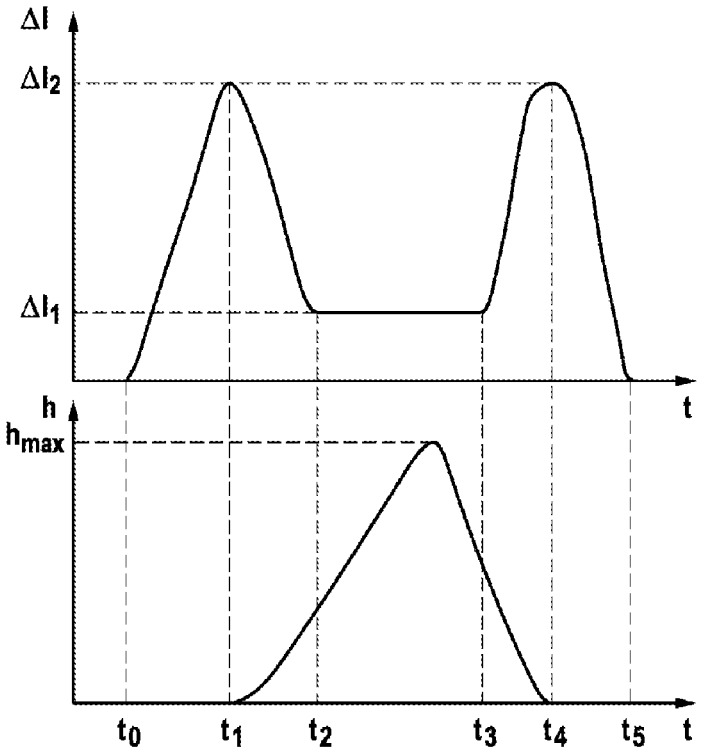
FIG. 3: a diagram of the change in length of the nozzle needle during an injection process and during the needle stroke as a function of time.

At time $t_3$ the nozzle needle 3 reaches a position at which the seat throttling between the sealing surface 6 and the nozzle seat 5 results in a marked lessening of the hydraulic force on the sealing surface 6. As a result, the nozzle needle 3 lengthens again, resulting in an increase in the relative change in length Δl again to the value $\Delta l_2$ up until time $t_4$, as represented in FIG. 3. At time $t_4$ the nozzle needle 3 also reaches its abutment on the nozzle seat 5 again, so that the nozzle needle 3 is axially compressed again by the rising pressure in the control chamber 10, and attains its original length at time $t_5$.

Figure 4:
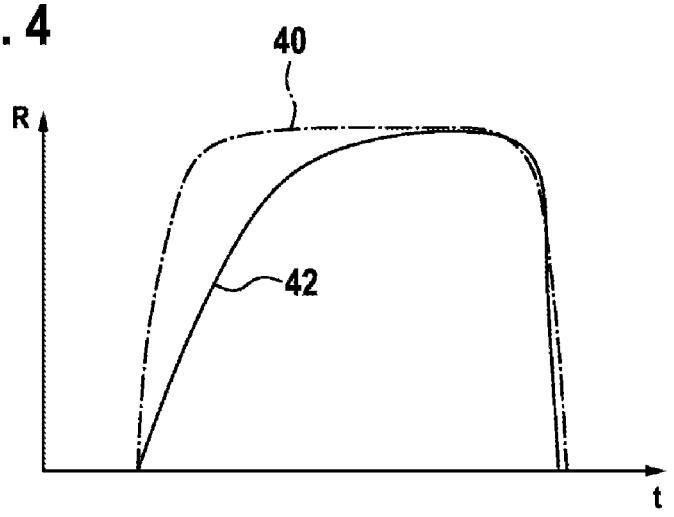
FIG. 4: the injection-rate in the temporal progression during an injection cycle in comparison with a conventional injection nozzle

In comparison with a known nozzle needle and its opening-stroke motion, which is determined exclusively by the hydraulic pressure within the control chamber, ultimately the following effect arises: as soon as the nozzle needle 3 begins its opening-stroke motion—that is to say, lifts away from the nozzle seat 5—the pressure infiltration of the sealing surface 6 commences and axially compresses the nozzle needle 3, this occurring in FIG. 3 between times $t_1$ and $t_2$. This axial compression of the nozzle needle 3, and hence its shortening, is added to the opening speed of the nozzle needle, so that the sealing surface 6 moves away from the nozzle seat 5 more quickly than the overall center of gravity of the nozzle needle 3. As a result, the injection-rate increases more quickly at the start of the injection than is the case with a normal nozzle needle 3. In order to illustrate this, in FIG. 4 the injection-rate R over time t during an injection is represented schematically. The dash-dotted line 40 represents the progression of the injection-rate of the nozzle needle 3 according to the invention: at the start of the injection the rate R rises much more rapidly than in the case of the known nozzle needle, the rate contour 42 of which is represented as a solid line. In the case of the nozzle needle according to the invention, the maximum rate is accordingly reached more quickly, so that only little fuel reaches the injection ports with low pressure and is insufficiently atomized as a result.

The effect according to the invention can also be explained and quantified as follows: once the pressure in the control chamber 10 falls, the end surface 9 of the nozzle needle 3 moves into the control chamber, without the sealing surface 6 moving for the time being. In the case of a longitudinal stiffness of the elastic portion of the nozzle needle of, for example, 15,000 N/mm, this effect amounts to approximately 30 μm if the nozzle needle consists of a customary steel with a modulus of elasticity of approximately 210,000 N/mm$^2$ and the diameter of the elastic portion amounts to 1.5 mm in the case of a length of 26 mm, the longitudinally elastic portion being of circular cylindrical design. As soon as the lengthening of the nozzle needle 3 has been concluded, the sealing surface 6 moves away from the nozzle seat 5 at a certain opening speed.

By virtue of the pressure infiltration of the sealing surface 6, the nozzle needle 3 is now axially compressed again, so that the elastic deformation of the nozzle needle 3 is added to the speed of motion of the nozzle needle 3. The sealing surface 6 accordingly moves away from the nozzle seat 5 more rapidly than it would do without the elastic portion 25.

The longitudinal stiffness is defined as follows:

In general, for the strain $\varepsilon_x$ in the longitudinal direction of the nozzle needle (here: the x-direction) it holds that $$\varepsilon_x = E^{-1}\cdot[\sigma_x - v\cdot(\sigma_y+\sigma_z)]$$

Here, $\sigma_x$, $\sigma_y$ and $\sigma_z$ are the stresses in the respective direction in space, v is Poisson's ratio, and E is the modulus of elasticity. For the following consideration, however, the strain contribution by the hydrostatic pressure in the pressure chamber (stresses $\sigma_y$ and $\sigma_z$) can be neglected, since this contribution remains practically unchanged during the entire injection cycle. The above relationship is then simplified, in a manner analogous to a unidirectional load, to give $$\sigma = E\cdot\varepsilon$$

In the following consideration, a longitudinally elastic portion will be assumed which consists of a solid cylindrical portion of the nozzle needle, with a diameter d, a cross-section A and a length L. If the stresses σ of the above equation are replaced by F/A, there results $$F/A = E\cdot\varepsilon$$

The strain ε is given as the quotient of the relative change in length ΔL and the overall length L of the portion—that is to say, ε=ΔL/L. If the two are substituted into one another, there results $$F/A = E\cdot\Delta L/L$$

or $$F = E\cdot A/L\cdot\Delta L$$

The proportionality factor between the force F and the relative change in length ΔL is designated as the longitudinal stiffness c, which is therefore given by the following relationship:

$$c = F/\Delta L = E\cdot A/L$$

If the value of E=210,000 N/mm$^2$ which is typical of steel is inserted, and a diameter d of the longitudinally elastic portion 25 of 1.5 mm and a length L of 26 mm, a longitudinal stiffness arises of $$c = 210{,}000\ \text{N/mm}^2\cdot\pi/4\cdot(1.5\ \text{mm})^2/26\ \text{mm} \approx 14{,}300\ \text{N/mm}$$

But good effects are already obtained also in the case of a higher longitudinal stiffness c, though the longitudinal stiffness c should be less than 40,000 N/mm, in order that an effect in an injection nozzle is to be observed.

Figure 5:
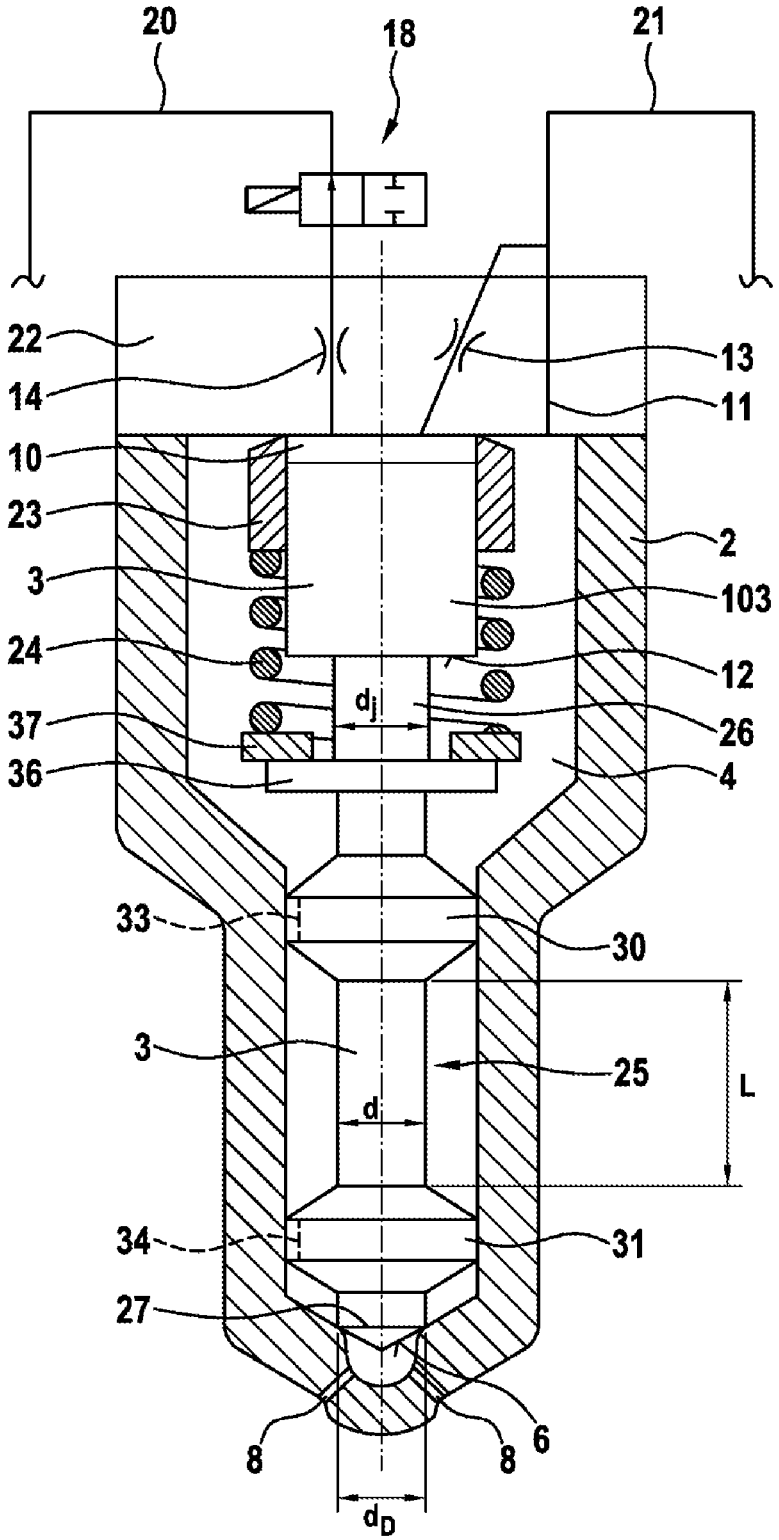
FIG. 5: in longitudinal section, a likewise schematic representation of an injection nozzle according to the invention.

In FIG. 5 an embodiment of the injection nozzle 1 according to the invention is represented schematically, wherein identical components bear the same reference numerals as in FIG. 1. The injection nozzle 1 has a nozzle body 2 in which a pressure chamber 4 has been formed which can be filled with fuel under high pressure, as already represented in FIG. 1. The nozzle needle 3 is piston-shaped and has a first guide portion 30 and a second guide portion 31 with which the nozzle needle 3 is guided in the radial direction within the pressure chamber 4. Between the first guide portion 30 and the second guide portion 31 the elastic longitudinal portion 25 has been formed which has a diameter d and has a length L. Facing away from the sealing surface 6, the nozzle needle 3 is guided with a cylindrical portion in a sleeve 23 which delimits the control chamber 10 in the radial direction. In this process the sleeve 23 is pressed against a throttle plate 22 by the force of a closing spring 24, said closing spring 24 being arranged under initial compressive tension between the sleeve 23 and a shoulder 36 of the nozzle needle 3, and surrounding the nozzle needle 3. Between the closing spring 24 and the shoulder 36 a shim 37 is arranged, via the thickness of which the initial compressive tension of the closing spring 24 is adjustable.

In the embodiment represented, between a guide portion 103 of the nozzle needle 3 and the shoulder 36 there is located a further elastic longitudinal portion 26 of the nozzle needle 3, which has a diameter $d_j$ which corresponds at least approximately to the diameter d of the elastic longitudinal portion 25. By virtue of the further elastic longitudinal portion 26, the overall stiffness of the nozzle needle 3 can be lowered further if, for example, the elastic longitudinal portion 25 cannot be manufactured in the necessary length for reasons of space.

The overall longitudinal stiffness $c_{ges}$ of the elastic longitudinal portions then amounts to $$c_{ges} = 1/(c_1^{-1}+c_2^{-1})$$

if $c_1$ and $c_2$ are the longitudinal stiffnesses of the two elastic portions 25, 26. The overall longitudinal stiffness $c_{ges}$ preferentially lies below 20,000 N/mm.

For the purpose of ensuring the flow of fuel within the pressure chamber 4 in the direction of the injection ports 8, on the first guide portion 30 and on the second guide portion 31 one or more polished sections 33 and 34, respectively, have been attached to the outside of the guide portions 30, 31, so that an unthrottled flow of fuel can occur past the guide portions 30, 31 in the direction of the injection ports 8.

In addition to the design of the elastic longitudinal portion 25 in the form of a circular cylinder with reduced diameter, it is also possible to construct this elastic longitudinal portion in a different manner, for example by a higher longitudinal elasticity being obtained by virtue of recesses in the nozzle needle. However, the design by virtue of a reduction of diameter is the simplest way to construct such a longitudinally elastic portion without the costs of manufacture of the nozzle needle rising appreciably as a result.

What is claimed is:

1. An injection nozzle (1) for fuels, comprising a nozzle body (2) having therein a pressure chamber (4) which is configured to be filled with fuel under high pressure and in which a piston-shaped nozzle needle (3) is arranged in longitudinally mobile manner, the nozzle needle having at one end a sealing surface (6) and at an opposite end an end surface (9), said sealing surface (6) interacting with a nozzle seat (5) for opening and closing at least one injection port (8), and with the injection nozzle also comprising a control chamber (10) which is configured to be filled with fuel under variable pressure and which the nozzle needle (3) delimits with the end surface (9), so that a force is exerted on the nozzle seat (5) by a hydraulic pressure on the end surface (9), characterized in that the nozzle needle (3) has an elastic longitudinal portion (25) which has a longitudinal stiffness of less than 40,000 N/mm, wherein the elastic longitudinal portion has a diameter and a length, wherein the nozzle needle (3) includes guide portions (30; 31) formed on the nozzle needle (3) respectively upstream and downstream of the elastic longitudinal portion (25), wherein the guide portions limit radial movement of the nozzle needle, wherein the guide portions each have a diameter larger than the diameter of the elastic longitudinal portion and a length shorter the length of the elastic longitudinal portion, and wherein the guide portions include respective passages (33; 34) that ensure a throttle-free flow of fuel to the at least one injection port (8) within the pressure chamber (4).

2. The injection nozzle (1) as claimed in claim 1, characterized in that the elastic longitudinal portion (25) of the nozzle needle (3) has a stiffness (c) of less than 20,000 N/mm.

3. The injection nozzle as claimed in claim 1, characterized in that the elastic longitudinal portion (25) has a circular cylindrical shape.

4. The injection nozzle (1) as claimed in claim 1, characterized in that the nozzle needle (3) is manufactured from a steel, and the diameter of the elastic longitudinal portion (25) is from 1.3 mm to 2.0 mm.

5. The injection nozzle (1) as claimed in claim 4, characterized in that the steel has a modulus of elasticity from 200,000 $N/mm^2$ to 230,000 $N/mm^2$.

6. The injection nozzle (1) as claimed in claim 1, wherein the length of the elastic longitudinal portion (25) is less than 30 mm.

7. The injection nozzle (1) as claimed in claim 6, characterized in that more than one elastic longitudinal portion (25; 26) have been provided, each elastic longitudinal portion (25; 26) having a length (L) of less than 30 mm.

8. The injection nozzle (1) as claimed in claim 7, wherein overall combined stiffness of the more than one elastic longitudinal portions (25; 26) amounts to less than 20,000 N/mm.

9. The injection nozzle (1) as claimed in claim 1, characterized in that the sealing surface (6) of the nozzle needle (3) has an annular sealing line (27) with which in the closed state of the injection nozzle (1) the nozzle needle rests on the nozzle seat (5) and seals the pressure chamber (4) against the at least one injection port (8).

10. The injection nozzle (1) as claimed in claim 3, characterized in that the sealing surface (6) of the nozzle needle (3) has an annular sealing line (27) with which in the closed state of the injection nozzle (1) the nozzle needle rests on the nozzle seat (5) and seals the pressure chamber (4) against the at least one injection port (8), and the diameter (d) of the elastic longitudinal portion (25) is at least equal to a diameter (db) of the annular sealing line (27).

11. The injection nozzle (1) as claimed in claim 1, characterized in that the end of the nozzle needle (3) facing away from the sealing surface (6) is accommodated in a sleeve (23) which radially delimits the control chamber (10).

12. The injection nozzle (1) as claimed in claim 11, characterized in that a closing spring (24) under initial compressive tension, which exerts a force on the nozzle needle (3) in a direction toward the nozzle seat (5), is arranged between the sleeve (23) and the nozzle needle (3).

13. A fuel injector (100) for injecting fuel into a combustion chamber of an internal-combustion engine, the fuel injector comprising an injection nozzle (1) as claimed in claim 1.

14. The injection nozzle (1) as claimed in claim 1, characterized in that the elastic longitudinal portion (25) of the nozzle needle (3) has a stiffness (c) from 12,000 N/mm to 16,000 N/mm.

15. The injection nozzle (1) as claimed in claim 1, characterized in that the elastic longitudinal portion (25) of the nozzle needle (3) has a stiffness (c) from 14,000 N/mm to 16,000 N/mm.

16. The injection nozzle (1) as claimed in claim 1, characterized in that the nozzle needle (3) has been manufactured from a steel, and the diameter of the elastic longitudinal portion (25) is from 1.4 mm to 1.6 mm.

17. The injection nozzle (1) as claimed in claim 4, characterized in that the steel has a modulus of elasticity of at least 210,000 $N/mm^2$.

18. The injection nozzle (1) as claimed in claim 1, wherein the length of the elastic longitudinal portion (25) is from 15 mm to 28 mm.

* * * * *